United States Patent [19]

Schmidt

[11] Patent Number: 4,944,449

[45] Date of Patent: Jul. 31, 1990

[54] OVERSIZE LASER MAILER AND RETURN ENVELOPE AND METHOD

[75] Inventor: Eric Schmidt, Elgin, Ill.

[73] Assignee: Wallace Computer Services, Inc., Hillside, Ill.

[21] Appl. No.: 391,300

[22] Filed: Aug. 9, 1989

Related U.S. Application Data

[63] Continuation-in-part of Ser. No. 391,302, Aug. 7, 1989.

[51] Int. Cl.[5] ..... B65D 27/06; B65D 27/12

[52] U.S. Cl. ..... 229/73; 229/92.7

[58] Field of Search ..... 229/73, 92.1, 92.7

[56] References Cited

U.S. PATENT DOCUMENTS

| | | | |
|---|---|---|---|
| 882,297 | 3/1908 | Cook | 229/92.7 |
| 1,280,723 | 10/1918 | Harris | 229/92.1 |
| 2,152,135 | 3/1939 | Case et al. | 229/92.1 |
| 2,316,757 | 4/1943 | Berkowitz | 229/92.7 |
| 2,881,971 | 4/1959 | De Tolve | 229/92.1 |
| 3,525,469 | 8/1970 | Sawdon | 229/92.7 |
| 3,606,138 | 9/1971 | Allison | 229/92.7 |
| 4,487,360 | 12/1984 | Fisher et al. | 229/92.7 |
| 4,630,768 | 12/1986 | Bradley | 229/92.7 |

*Primary Examiner*—Stephen P. Garbe

*Attorney, Agent, or Firm*—Tilton, Fallon, Lungmus & Chestnut

[57] ABSTRACT

Oversized laser mailer and return envelope and method wherein a sheet such as 17"×11" has static information on one face and variable information on the other face, the sheet being transversely folded to provide an overlapping edge, equipped with lines of glue adjacent the folded edges as well as adhesive ribbons on the variable information face, longitudinally folded and equipped with transverse lines of perforation adjacent the edges to provide tear off strips whereby removal of the tear off strips results in two separate sheets, one of which is a return envelope.

3 Claims, 2 Drawing Sheets

OVERSIZE LASER MAILER AND RETURN ENVELOPE AND METHOD

This application is a continuation-in-part of my co-pending application Ser. No. 07/391,302, filed 8/7/89.

BACKGROUND AND SUMMARY OF INVENTION

This invention relates to an oversize laser mailer and return envelope and method, being an improvement on co-owned patent No. 4,754,915, and, more particularly, to an improvement on my co-pending application Serial No. 07/391,302, filed 8/9/89 differing therefrom essentially in providing a conventional return envelope.

There has been a need for providing more information on mailers than that which has been possible with the construction of Patent No. 4,754,915. This is achieved through the above-mentioned application and the instant invention by providing an oversize sheet (say 17" by 11") and subsequently folding, gluing and perforating the sheet into a mailing piece. Once opened, the mailing piece provides a two sheet mailer, each sheet being slightly under one half the size of the original single sheet. By this construction, it is possible to increase the amount of information area in the mailing piece, both of the static and the variable type of information now, by applying additional transverse ribbons of adhesive and a longitudinal perforation, a conventional return envelope.

The invention is described in conjunction with the accompanying drawing, in which FIG. 1 is a plan view of the face of the oversize sheet which carries the static information, i.e., the information that does not change in going from one mailer to another;

DETAILED DESCRIPTION

The disclosure of my co-pending application Serial No. 07/391,302, filed 8/9/89 is hereby incorporated by express reference and reference may be made thereto for additional details of construction and operation not specifically set forth herein.

Figure 1:
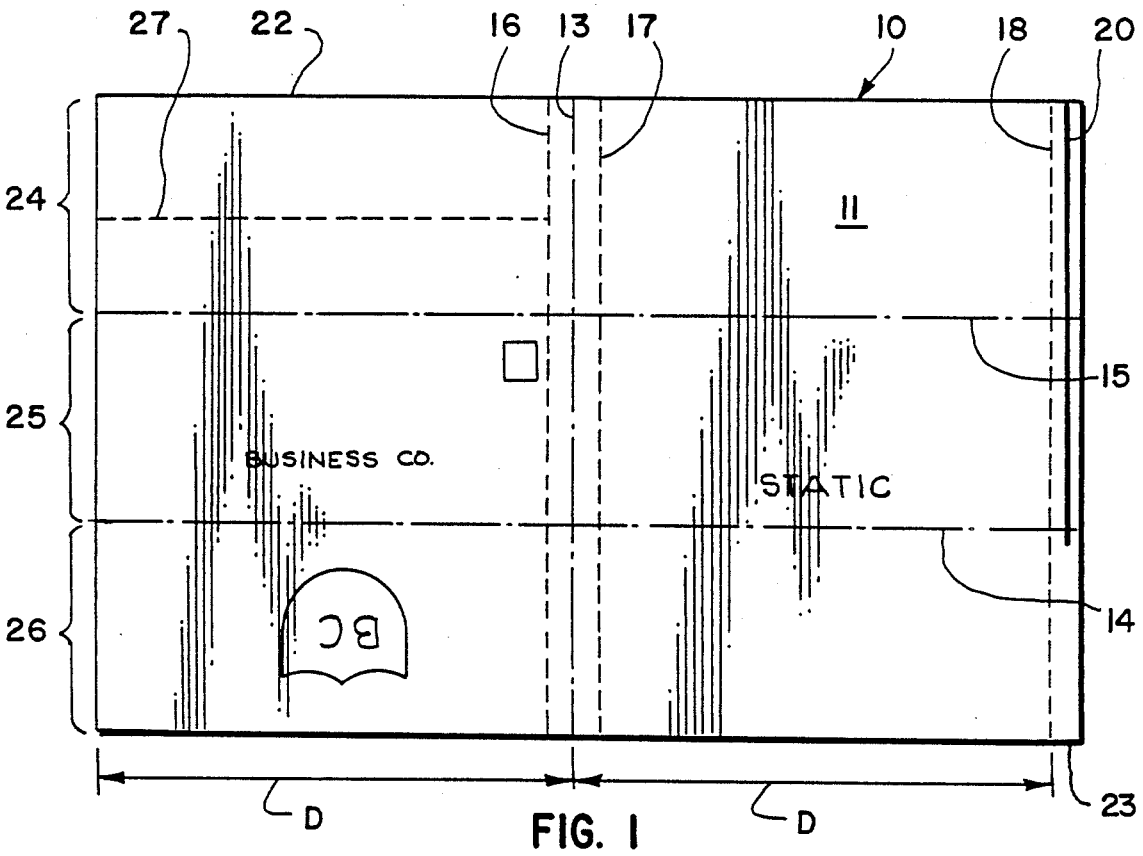

In the illustration given and with reference first to FIG. 1, the oversize mailer is generally designated 10. It is rectangular (17"×11") and is characterized by a first face 11 which carries the static information, i.e., that which does not change in going from one mailer to another.

Figure 2:
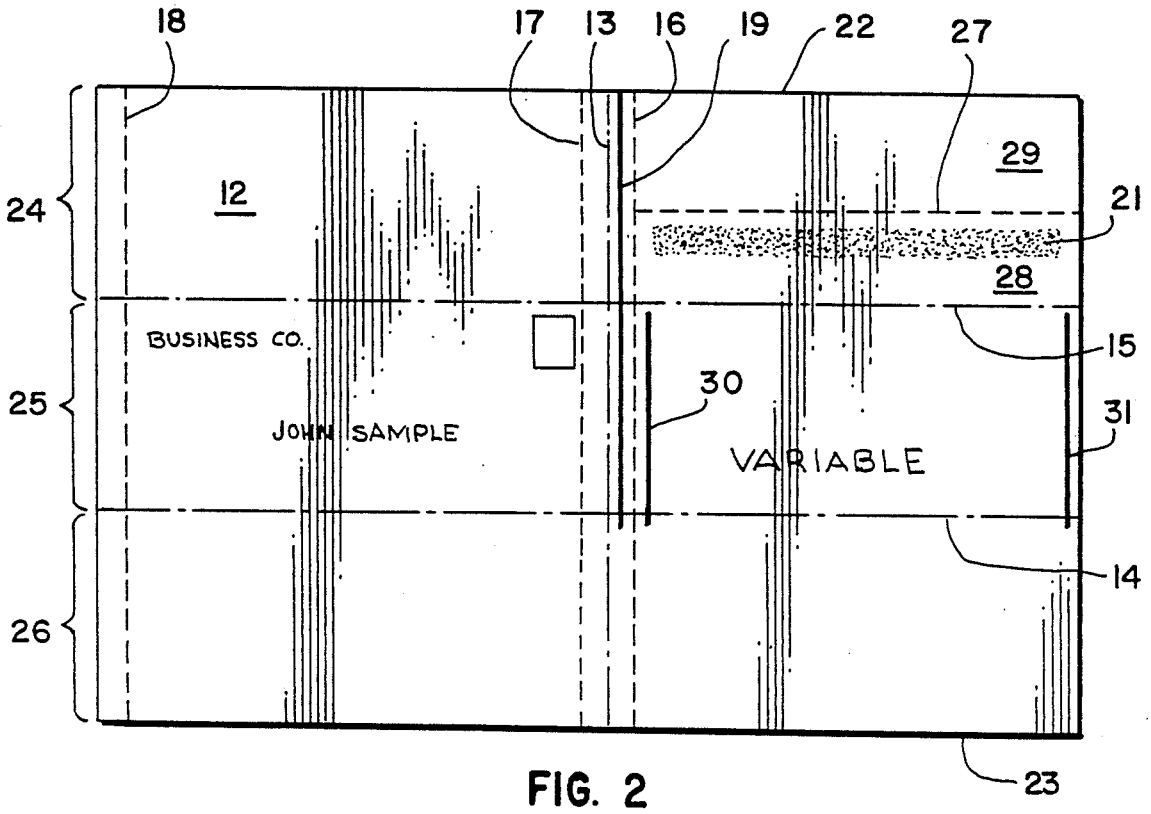
FIG. 2 is a plan view of the opposite face of the oversize mailer as would be seen by turning the construction of FIG. 1 180°, end-for-end.

The reverse face 12 is seen in FIG. 2 and this carries the variable information which does change in going from mailer to mailer. In both FIGS. 1 and 2 there is a transverse fold line 13 (slightly off center longitudinally) which is represented by a chain line, i.e., a dot-long dash line. The off-center position can be appreciated from the dimension lines D in FIG. 1. Two other fold lines are illustrated as at 14 and 15 which are longitudinal folds.

Also illustrated in FIGS. 1 and 2 are three transversely extending lines of perforation which are illustrated with short dashes as at 16, 17 and 18. These are employed to provide tear off strips for opening the mailer.

Also seen in FIGS. 1 and 2 are glue lines which extend partly transversely of the mailer 10 and which are designated 19 in FIG. 2 for the adhesive applied to the variable face 12 and 20 in FIG. 1 for the adhesive applied to the static face 11.

The invention makes use of the oversize mailer to provide a return envelope and, for this, a band of remoistenable adhesive 21 (see the upper right hand portion of FIG. 2) is provided. The longitudinal folds 14, 15 are spaced substantially between the longitudinal edges or sides 22, 23 so as to provide three substantially equal panels 24, 25, 26. Also provided is a longitudinally extending line of perforation 27 separating the right hand portion of the panel 23 into a flap portion 28 and a return information portion 29. Still further, I provide a pair of transversely extending adhesive ribbons 30, 31 in the right hand portion of panel 25, also on the variable face 12.

It is believed that the invention will be better understood by a consideration of the method of making the same.

Method of Making

Figure 3:
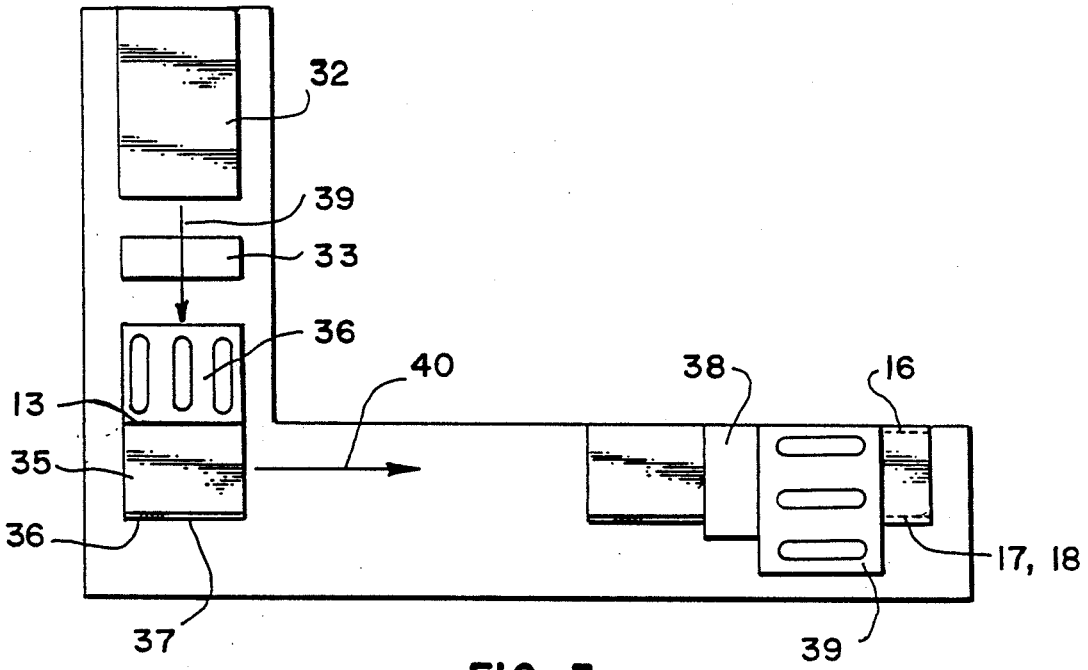
FIG. 3 is a schematic view of apparatus employed in practicing the method of the invention.

Now referring to the left hand portion of FIG. 3, the numeral 32 designates a stack of sheets cut to size for processing through a laser printer 33. The printer 33 prints the variable information generated by an associated computer. Prior to being cut, the sheets of stack 32 may be equipped with the band of remoistenable adhesive 21, as well as the static information and the longitudinal perforation line 27. This is conveniently done on a conventional press (not shown). The printing operation is now completed and folding now occurs.

The transverse fold 13 achieved through a buckle folder 34 of known construction—see my earlier application Serial No. 244,727, filed Sept. 15, 1988. There, a pair of chute-providing plates operate in conjunction with pull rolls to fold the mailer blank or sheet 10 on itself. As indicated in FIG. 4, the fold plies 35 and 36 are different lengths so as to provide a slight overlap portion 37 as seen in FIG. 5.

Figure 4:
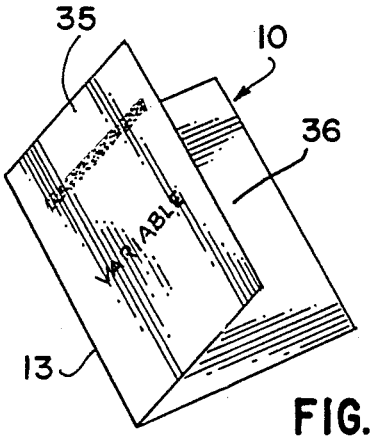
FIGS. 4 and 5 are schematic views showing certain steps in the method of practicing the invention.
Figure 5:
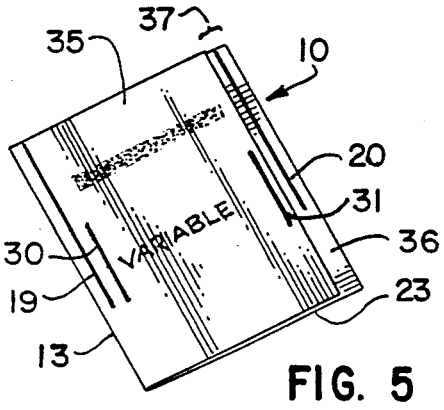

The step of transversely folding is illustrated schematically in FIG. 4 and in its completed form in FIG. 5. FIG. 5 also illustrates the application of two lines of glue which have been previously referred to at 19 and 20. These are applied through the use of an adhesive unit 38 which can be seen in the right hand portion of FIG. 3—this after the blank 10 has been folded along the line 13 and thereafter advanced at 90° to its previous path, as indicated by the arrows 39, 40. The ribbons of adhesive 19, 20 do not extend completely across the width of the mailer 10 because there is no need to apply adhesive to the lowermost panel 26—see FIG. 1. This is the portion of the mailer between the longitudinal fold line 14 and its adjacent longer side 23. This panel 26 is adhered to the panel 25 incident to longitudinal folding by virtue of the glue lines 19, 20 which have been applied to the panels 24, 25.

Because I change the direction of advance of the folded blanks 90°, the glue line 20 can be conveniently laid down by adhesive printing rolls on the static face while the same rolls apply the line 19 to the variable face. At the same time, the adhesive ribbons 30, 31 can be applied to the variable face.

The steps of longitudinally folding along the lines 14, 15 is achieved in the inventive method by means of another buckle folder 39. Buckle folders are constructed to make up to four folds in the same apparatus. Also associated with the buckle folder 39 is a transverse perforator (not shown) for developing the perforation lines 16 and 17, 18—see the folded mailer 30 extreme right in FIG. 3.

It will also be appreciated that the terms "longitudinal" and "transverse" as used herein refer to the long and short dimensions of the sheet or blank 10—and not to the direction of advance or the dimensions of the folded sheet. For example, in FIG. 5, the dimension parallel to the edge 23 is 8¾" and that parallel to the fold line 13 is 11". Nonetheless, the 8¾" dimension is longitudinal and the 11" dimension is transverse to agree with the nomenclature applied to the unfolded sheet 10.

Figure 6:
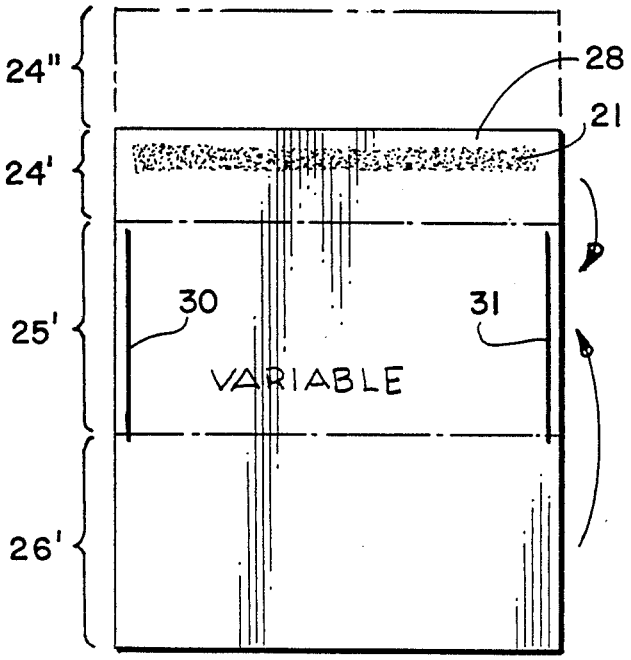
FIG. 6 is a schematic plan view illustrating the use of the return envelope of the invention.

Once the completed mailer has been received by the intended recipient, the tear strips defined by the lined perforation lines 16 on one side and 17, 18 on the other, can be removed. This results in a pair of sheets, one of which is useful as a return envelope. This return envelope is illustrated schematically in FIG. 6 and makes use of the partial panels 26' as the envelope back, 25' as the envelope front and 24' as the envelope flap. It will be appreciated that incident to the double longitudinal folding, the partial panel 26' is adhered to the partial panel 25' by virtue of the adhesive ribbons 30, 31. Even though the partial panel 24' constituting the envelope flap 28 is folded, it is not secured to the envelope back because the adhesive 21 requires remoistening. The remainder of the panel 24 is shown in dotted line at 24" and represents the return information partial panel which can be included when the return envelope is sent back to the original sender.

While in the foregoing specification a detailed description of an embodiment of the invention has been set down for the purpose of illustration, many variations in the details hereingiven may be made by those skilled in the art without departing from the spirit and scope of the invention.

I claim:

1. A folded single sheet mailer comprising a rectangular sheet having two long sides and two short sides, said sheet on one face being imprinted with variable information and static information on the other face, said sheet being folded on itself transverse to said long sides along a line offset from the middle of said sheet to provide one fold ply extending beyond the other fold ply and with the variable information containing face positioned outwardly, a transverse line of perforation in said one ply in the portion extending beyond the other fold ply, a transversely extending glue line on said static information face in said extending portion between said transverse line of perforation and the adjacent short side, superposed lines of transverse perforation in said one fold ply and said other fold ply adjacent said transverse fold line, a transversely extending glue line on said other ply on said variable information containing face between said superposed lines of perforation and said fold line, said sheet being folded on itself along two spaced apart longitudinally extending fold lines to provide a sealed outgoing envelope openable by tearing along said lines of transverse perforation, said longitudinally extending fold lines being substantially equally spaced relative to the said long sides to provide three substantially equal side-by-side panels in said other ply, the middle of said three panels on said variable information face being equipped with transversely extending ribbons of adhesive adjacent to said transverse lines of perforation to provide a return envelope after said envelope is open.

2. The structure of claim 1 in which one end panel of said three side-by-side panels is equipped with a longitudinally extending line of perforation to provide a flap portion adjacent said middle panel, and remoistenable adhesive on said flap portion variable information face.

3. The structure of claim 2 in which said one end panel provides a return information portion between said longitudinally extending line of perforation and the long side adjacent said one end panel.

* * * * *